US006434218B1

(12) United States Patent
Matsumoto

(10) Patent No.: US 6,434,218 B1
(45) Date of Patent: Aug. 13, 2002

(54) RADIATION PHOTOGRAPHING APPARATUS

(75) Inventor: Kazuhiro Matsumoto, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/385,049

(22) Filed: Aug. 30, 1999

(30) Foreign Application Priority Data

Aug. 31, 1998 (JP) ..... 10-260842
Aug. 24, 1999 (JP) ..... 11-237291

(51) Int. Cl.[7] ..... G21K 1/00
(52) U.S. Cl. ..... 378/155; 378/154; 378/98.8
(58) Field of Search ..... 378/155, 154, 378/98.8, 62, 116, 181

(56) References Cited

U.S. PATENT DOCUMENTS 2,333,720 A * 11/1943 Hollstein ..... 378/116
4,760,589 A * 7/1988 Siczek ..... 378/155
6,072,188 A * 6/2000 Arakawa ..... 378/155
6,157,700 A * 12/2000 Sako ..... 378/154
6,167,115 A * 12/2000 Inoue ..... 378/154

FOREIGN PATENT DOCUMENTS

JP 6-18571 1/1994
JP 8-116044 5/1996

* cited by examiner

*Primary Examiner*—Drew A. Dunn
(74) *Attorney, Agent, or Firm*—Fitzpatrick, Cella, Harper & Scinto

(57) ABSTRACT

A radiation photographing apparatus has a radiation image receiving portion for receiving radiation transmitted through an object and obtaining a radiation transmission image, and a grid to be disposed on the object side of the radiation image receiving portion. The grid includes a scattered ray removing member or a radiation detector. The grid is constructed for movement also to the side opposite to the object side of the radiation image receiving portion.

21 Claims, 17 Drawing Sheets

RADIATION PHOTOGRAPHING APPARATUS

BACKGROUND OF THE INVENTION

1. Field of the Invention

This invention relates to a radiation photographing apparatus for obtaining a radiation image of an object to which radiation such as X-rays is applied.

2. Related Background Art

The radiation photographing apparatus of this kind has heretofore been used in various fields and particularly, in radiation photographing directed to the medical diagnosis of human bodies and the non-destruction inspection of substances, a so-called radiation photographic method using a combination of an intensifying screen and radiation photographic film has been utilized. In the radiation photographing apparatus adopting this radiation photographic method, when radiation is transmitted through an object and is incident on the intensifying screen, a fluorescent material contained in the intensifying screen absorbs the incident radiation energy and emits fluorescence. Thereby, the radiation photographic film which is in close contact with the intensifying screen is sensitized and a radiation image appears as a visible image on the radiation photographic film.

Also, there has been devised a radiation image recording-reproducing system utilizing an accumulative fluorescent material. The accumulative fluorescent material accumulates part of radiation energy therein when the radiation is applied thereto, and produces accelerated emitted light conforming to the accumulated radiation energy when exciting light such as visible light is applied. In such a radiation image recording-reproducing system, the radiation image information of an object such as a human body is once recorded on an accumulative fluorescent material sheet and exciting light such as a laser beam is scanned on the accumulative fluorescent material sheet by image reading means to thereby produce accelerated emitted light. The accelerated emitted light is then photoelectrically read, and the radiation information of the object based on this read image signal is outputted as a visible image to a recording material such as a photographic photosensitive material or a CRT or the like.

Also, a radiation image digital detector for digital-outputting a radiation image in real time is disclosed, for example, in Japanese Patent Application Laid-Open No. 8-116044. The manufacture of this radiation image digital detector has become possible by the advance of the semiconductor process technique, and it comprises a solid state photodetector and a scintillator laminated one upon the other. The solid state photodetector comprises solid state photodetection elements comprising transparent electrically conductive film and electrically conductive film and they are arranged in the form of a matrix at the opposite sides of amorphous semiconductor film on a substrate formed of quartz glass, and the scintillator converts the radiation into visible light.

The construction in which this radiation image digital detector outputs a digital image is very simple, and when the radiation transmitted through the object is incident on the radiation image digital detector, the scintillator converts the radiation into visible light, and the photoelectric converting portions of the solid state photodetection elements detect the visible light as an electrical signal. This electrical signal is read from each solid state photodetection element by a predetermined reading method, and is A/D-converted. Signal processing means processes the A/D-converted radiation image signal, whereafter image reproducing means such as a CRT reproduces it as a radiation image, which is used for diagnosis by a medical doctor. In this case, the signal processing means can also reproduce a radiation image excellent in contrast or sharpness.

Such a radiation image digital detector is a flat panel having a thickness of several millimeters and therefore can very easily contribute to making the radiation photographing apparatus thin and light in weight. For example, FIG. 1 of the accompanying drawings shows a radiation photographing apparatus using a radiation image digital detector for upright photographing such as the simple photographing of the breast or the simple photographing of the abdomen, and the main body 2 of the apparatus is disposed forwardly of an X-ray generating portion 1, and the main body 2 of the apparatus is supported by the movable portion 3*a* of a stand 3. The main body 2 of the apparatus and a control portion 4 are connected together through a flexible cable 5 protected by a cover 5*a,* and the main body 2 of the apparatus is vertically moved in accordance with the height of an object and is fixed at an optimum position.

A grid 7 and an X-ray image receiving portion 8 are disposed in the housing 6 of the main body 2 of the apparatus in succession from the X-ray generating portion 1 side, and the X-ray image receiving portion 8 is comprised of a radiation image digital detector 9 and a reading circuit 10. The grid 7 removes the scattered rays from an object, not shown, and the reading circuit 10 reads a signal from the radiation image digital detector 9.

An image processing portion 12 and a power source portion 13 are disposed in the housing 11 of the control portion 4, and a display portion 14 such as a monitor is connected to the image processing portion 12. This display portion 14 is sometimes incorporated in the control portion 4. The image processing portion 12 effects a filtering process such as the noise reduction or edge emphasis of a digital signal supplied from the reading circuit 10, and the power source portion 13 supplies a power source to the radiation image digital detector 9, the reading circuit 10 and the image processing portion 12.

Sometimes an X-ray detector, not shown, is incorporated instead of the grid 7, or is incorporated between the grid 7 and the X-ray image receiving portion 8. This X-ray detector is generally called a phototimer and is connected to an X-ray automatic exposure control device, not shown, which is discretely installed. Since the exposure time of X-rays is automatically controlled by the X-ray automatic exposure control device even when the thickness or desired region of the object differs, an X-ray image receiving portion can always obtain an image of predetermined density. As a typical X-ray detector, there is known so-called photomultiplier using a photomultiplier tube, a semiconductor detector utilizing a semiconductor element, an ion chamber utilizing the electrolytic dissociation action of air by X-rays, or the like.

A radiation photographing apparatus which does not use the radiation image digital detector 9 is designed such that a cassette containing a sheet of radiation photographic film or an accumulative fluorescent material sheet therein is mounted on the X-ray image receiving portion 8 and X-rays are emitted from the X-ray generating portion 1 to thereby photograph the object, whereafter the cassette is taken out and is developed. In contrast, in a radiation photographing apparatus using the radiation image digital detector 9, the cumbersome work of mounting the cassette and taking out and developing the cassette can be eliminated and moreover, a photographed image can be displayed on the display portion 14 immediately after photographing, and even rare re-photographing can be coped with in a moment.

In contrast, when the above-described radiation photographing apparatus is used for the upright photographing of the breast or the abdomen, it is necessary to use the grid 7 to remove scattered rays, but when the radiation photographing apparatus is used for the photographing of a body portion such as the head or the limb, it is often the case that the grid 7 is not used because scattered rays are relatively few. Also, a good image free of spatial blur can be obtained if the radiation photographic film, the accumulative fluorescent material sheet and the radiation image digital detector 9 are brought into the closest possible contact with the object.

Therefore, a radiation photographing apparatus using the radiation photographic film or the accumulative fluorescent material sheet sometimes adopts a form of photographing in which the grid 7 is detachably mounted or the grid 7 and the X-ray detector are not used without these being mounted. Also, it sometimes adopts a form of photographing in which the single cassette loaded with the radiation photographic film or the accumulative fluorescent material sheet is intactly used and the grid 7 and the X-ray detector are not used.

However, when these forms of photographing are applied to a radiation photographing apparatus having the radiation image digital detector 9 mounted thereon, there arise the following problems:

(a) When the grid 7 or the X-ray detector is made detachably mountable from the side of the housing 6 of the main body by an automatic cassette loading mechanism, it is necessary to carry the taken-out grid 7 or X-ray detector to a depository or again carry it from the depository into the housing 6 of the main body and therefore, the work becomes cumbersome.

(b) It is conceivable to prepare two radiation photographing apparatuses each having the radiation image digital detector 9 mounted thereon and direct one of the two radiation photographing apparatuses to exclusive use in which the grid 7 or the X-ray detector is not used, but this is costly because the radiation image digital detector 9 is relatively expensive.

(c) Also, when as described in Japanese Patent Publication No. 6-18571, the retraction of the grid is effected by only parallel movement, an area substantially equal to at least the grid becomes necessary at the retracted position of the grid adjacent to the radiation image receiving portion, thus resulting in the bulkiness of the radiation photographing apparatus.

SUMMARY OF THE INVENTION

It is an object of the present invention to solve the above-noted problems and to provide a radiation photographing apparatus in which at least one of scattered ray removing means and radiation detecting means is easily retractable.

Other objects of the present invention will become apparent from the following description of some embodiments of the invention.

DESCRIPTION OF THE PREFERRED EMBODIMENTS

The present invention will hereinafter be described in detail with respect to some embodiments thereof shown in FIGS. 2A and 2B to 25.

Figure 1:
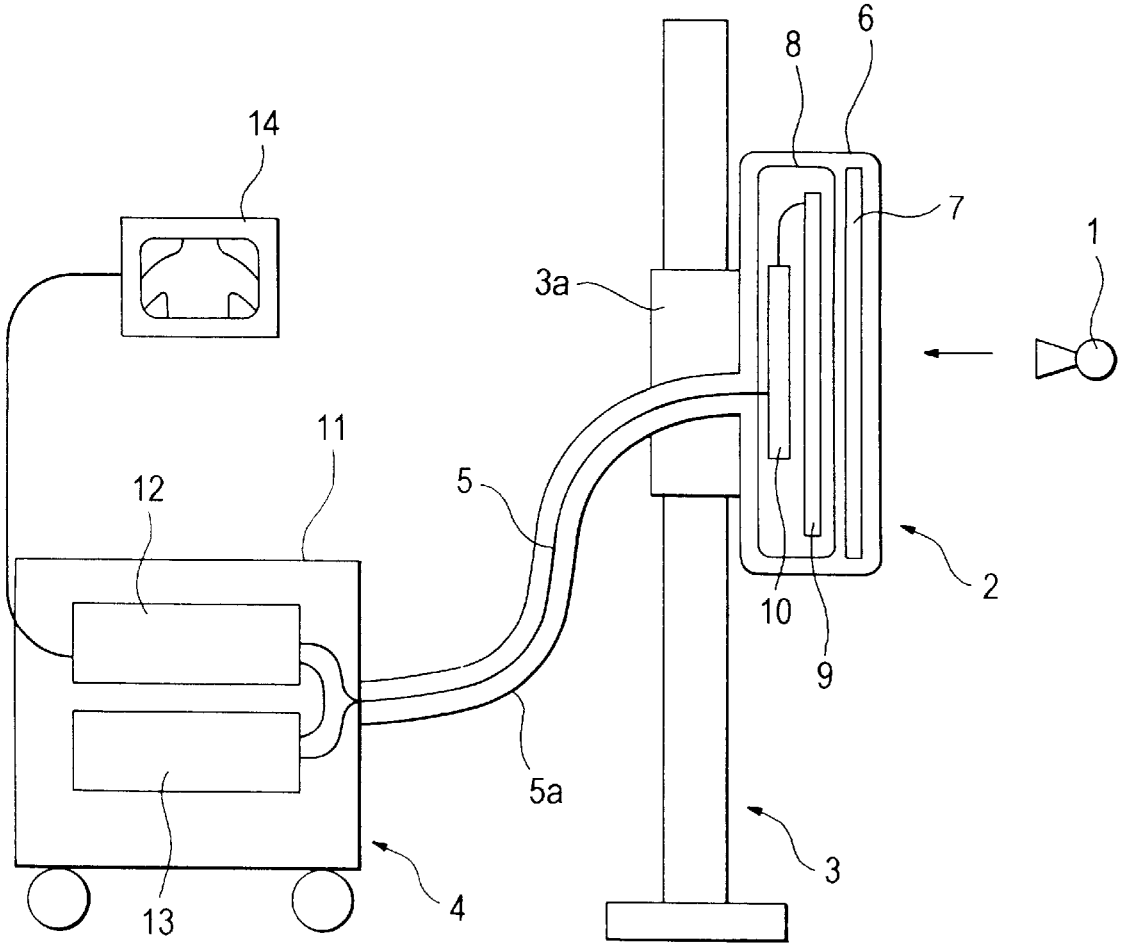
FIG. 1 PRIOR ART
FIG. 1 is a side view of an example of the prior art.
Figure 2A:
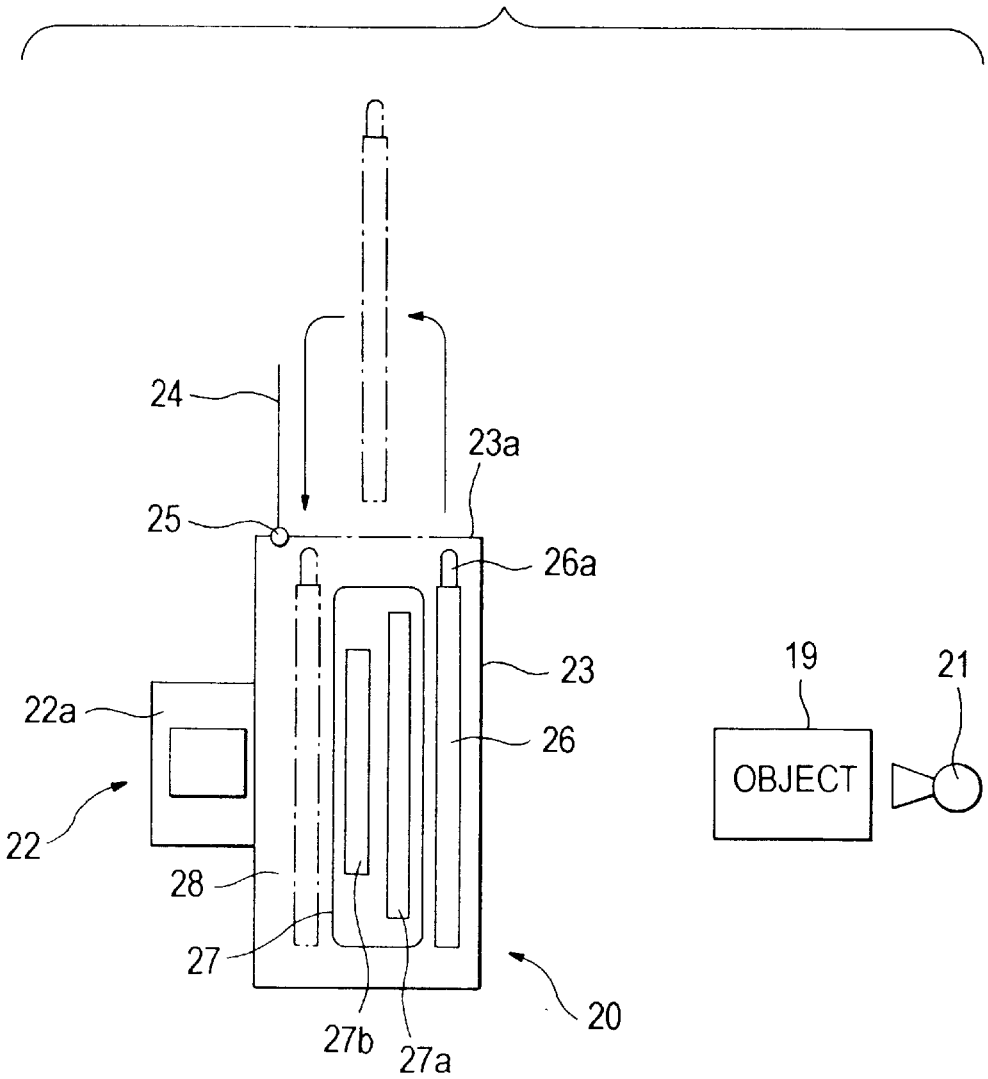
FIG. 2A is a plan view of the essential portions of a first embodiment of the present invention.
Figure 2B:
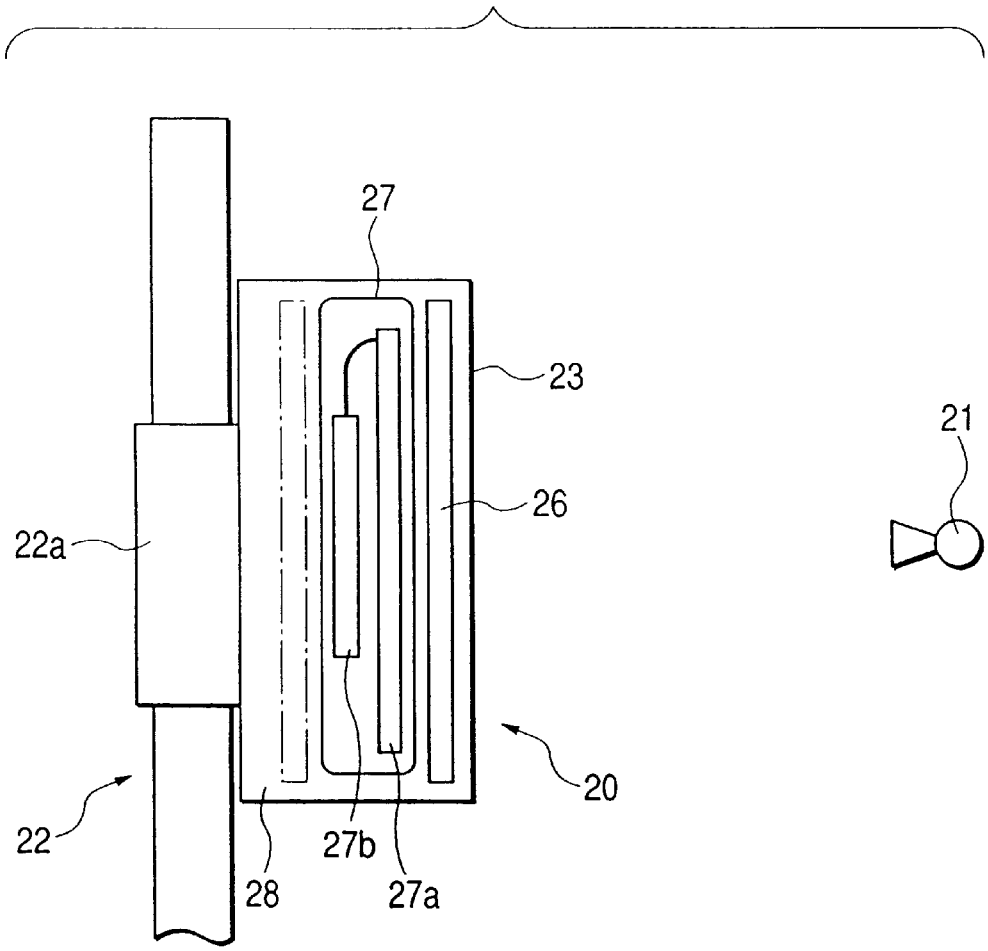
FIG. 2B is a side view of the first embodiment.

FIG. 2A is a plan view (a cross-sectional view) of the essential portions of a first embodiment, FIG. 2B is a side view (a cross-sectional view) thereof, the main body 20 of an apparatus is supported by the movable portion 22*a* of a stand 22 forwardly of an X-ray generating portion 21, and an object 19 is disposed between the main body 20 of the apparatus and the X-ray generating portion 21. The main body 20 of the apparatus is connected to a control portion provided with a signal processing portion, a power source portion, a display portion, etc., not shown, through a flexible cable, and the height of the main body 20 of the apparatus is adjustable by the movable portion 22*a* of the stand 22 in accordance with the height of the object.

An opening 23*a* is formed in a side of the main body housing 23 of the main body 20 of the apparatus, and a cover 24 for opening and closing this opening 23*a* is supported on the main body housing 23 by a hinge 25. A grid 26 and an X-ray image receiving portion 27 are disposed in the main body housing 23 in succession from the X-ray generating portion 21 side, and the rear of the X-ray image receiving portion 27 in the main body housing 23 is a grid retracting space 28 for retracting the grid 26 thereinto. The grid 26 is for removing the scattered rays from the object, and is stationarily disposed in front of the X-ray image receiving portion 27. A radiation image digital detector 27*a* and a reading circuit 27*b* are disposed in the X-ray image receiving portion 27 in succession from the grid 26 side. The reading circuit 27*b* is connected to the radiation image digital detector 27*a* and is adapted to read out a signal from the radiation image digital detector 27*a*.

The grid 26 is provided with a handle 26*a* for facilitating the mounting and dismounting thereof. A guide member, not shown, for guiding the grid 26 in parallelism to the X-ray image receiving portion 27 is provided in the space in the main body housing 23 containing the grid 26 therein and the grid retracting space 28. When the object is to be photographed without the use of the grid 26, the cover 24 is opened and the handle 26*a* of the grid 26 is grasped to thereby take the grid 26 out of the main body housing 23 as indicated by dot-and-dash line. The grid 26 thus taken out of the main body housing 23 is then inserted into the grid retracting space 28, and the cover 24 is closed. When taking out and inserting the grid 26, the grid 26 moves in parallelism to the X-ray image receiving portion 27 while being guided by the guide member.

As described above, in the first embodiment, the grid 26 can be easily retracted into the grid retracting space 28 and therefore, it becomes possible to easily effect photographing using the grid 26 and photographing not using the grid 26 by the use of the same main body 20 of the apparatus without moving the X-ray image receiving portion 27. Also, it is unnecessary to carry the grid 26 taken out of the main body housing 23, for example, to a specially installed custody shelf, and it is also unnecessary to provide the custody shelf. Accordingly, there is not the cumbersomeness of carrying the grid 26.

In this first embodiment, when photographing is to be effected by using the grid 26, the grid 26 is made stationary in front of the X-ray image receiving portion 27, but photographing can also be effected while the grid 26 is moved relative to the X-ray image receiving portion 27. In this case, provision can be made of driving means for moving the grid 26 at a predetermined speed and also, the grid 26 can be made separable from the driving means after retracted from the main body housing 23.

Figure 3:
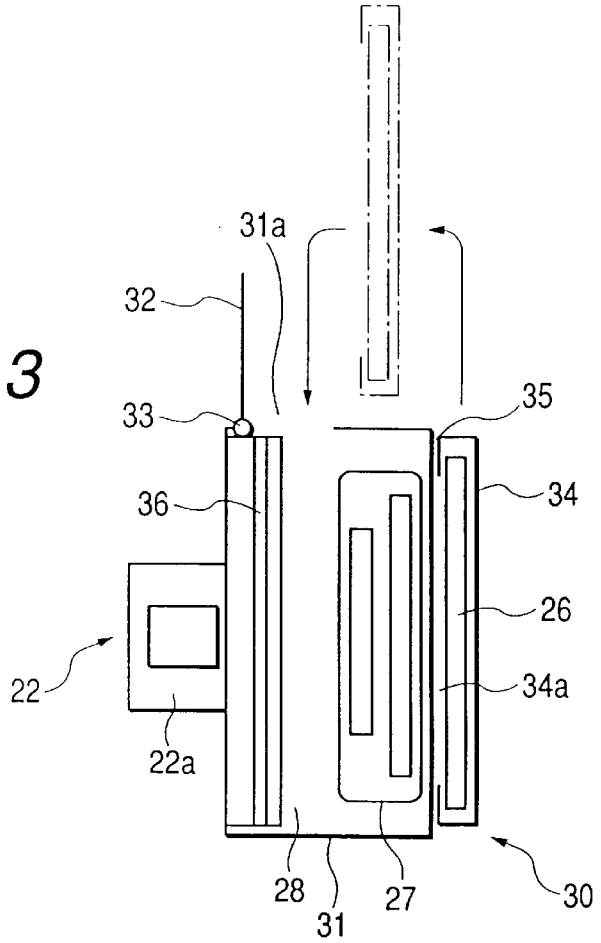
FIG. 3 is a plan view of the essential portions of a second embodiment of the present invention.
Figure 4:
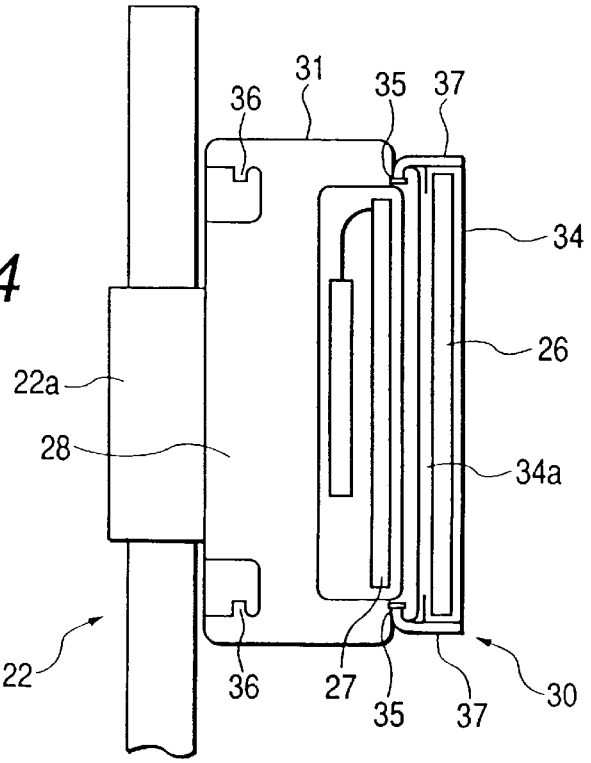
FIG. 4 is a side view of the second embodiment.

FIG. 3 is a plan view (a cross-sectional view) of the essential portions of a second embodiment, FIG. 4 is a side view (a cross-sectional view) thereof, and the grid 26 is detachably mountable on the main body housing 31 of the main body 30 of an apparatus through guide means and engagement means. An opening 31*a* is formed in a side of the main body housing 31, and a cover 32 for opening and closing this opening 31*a* is supported on the main body housing 31 by a hinge 33. An X-ray image receiving portion 27 and a grid retracting space 28 are provided in succession in the interior of the main body housing 31, and the grid 26 is supported in front of the main body housing 31 through a grid housing 34.

Guide grooves 35 are formed in the front portions of the upper and lower surfaces of the main body housing 31 over the full lateral length thereof, and similar guide grooves 36 are also formed in the rear portion of the grid retracting space 28. L-shaped engagement members 37 engaged with the guide grooves 35 and 36 are fixed to the upper and lower surfaces of the grid housing 34. The rear surface of the grid housing 34 is formed with an opening 34*a* somewhat larger than the area of a radiation image received by the X-ray image receiving portion 27, and the grid 26 is exposed to this opening 34*a*. Thereby, X-rays having image information transmitted through the object and the grid 26 are prevented from being inadvertently absorbed or scattered.

Figure 5:
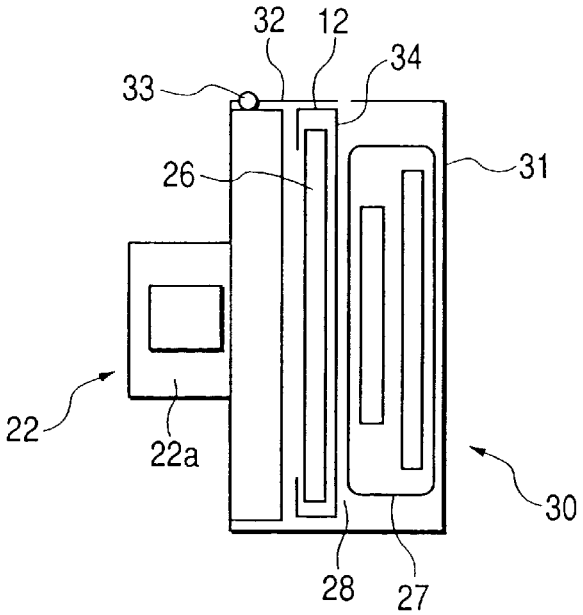
FIG. 5 is an illustration of action.
Figure 6:
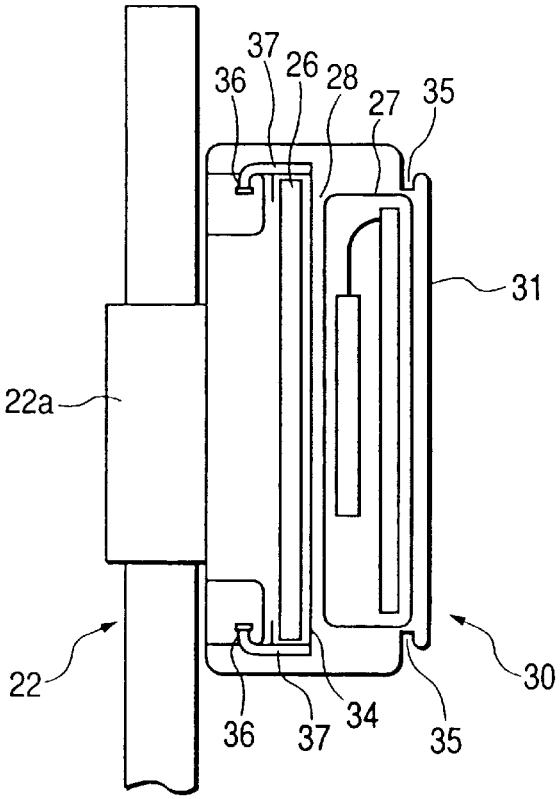
FIG. 6 is an illustration of action.

In the photographing not using the grid 26, the grid housing 34 is laterally moved, whereby the engagement member 37 of the grid housing 34 is guided by the guide grooves 35, and the grid housing 34 is detached from the main body housing 31 and is carried as indicated by dot-and-dash lines. The cover 32 is then opened, and as shown in FIGS. 5 and 6, the grid housing 34 is inserted into the grid retracting space 28 in the main body housing 31, and the cover 32 is closed. At this time, in the grid retracting space 28, the guide grooves 36 guide and support the engagement member 37 of the grid housing 34.

This second embodiment can achieve an effect similar to that of the first embodiment and moreover, can bring the object into closer contact with the X-ray image receiving portion 27 than in the first embodiment when photographing is effected without using the grid 26.

Figure 7:
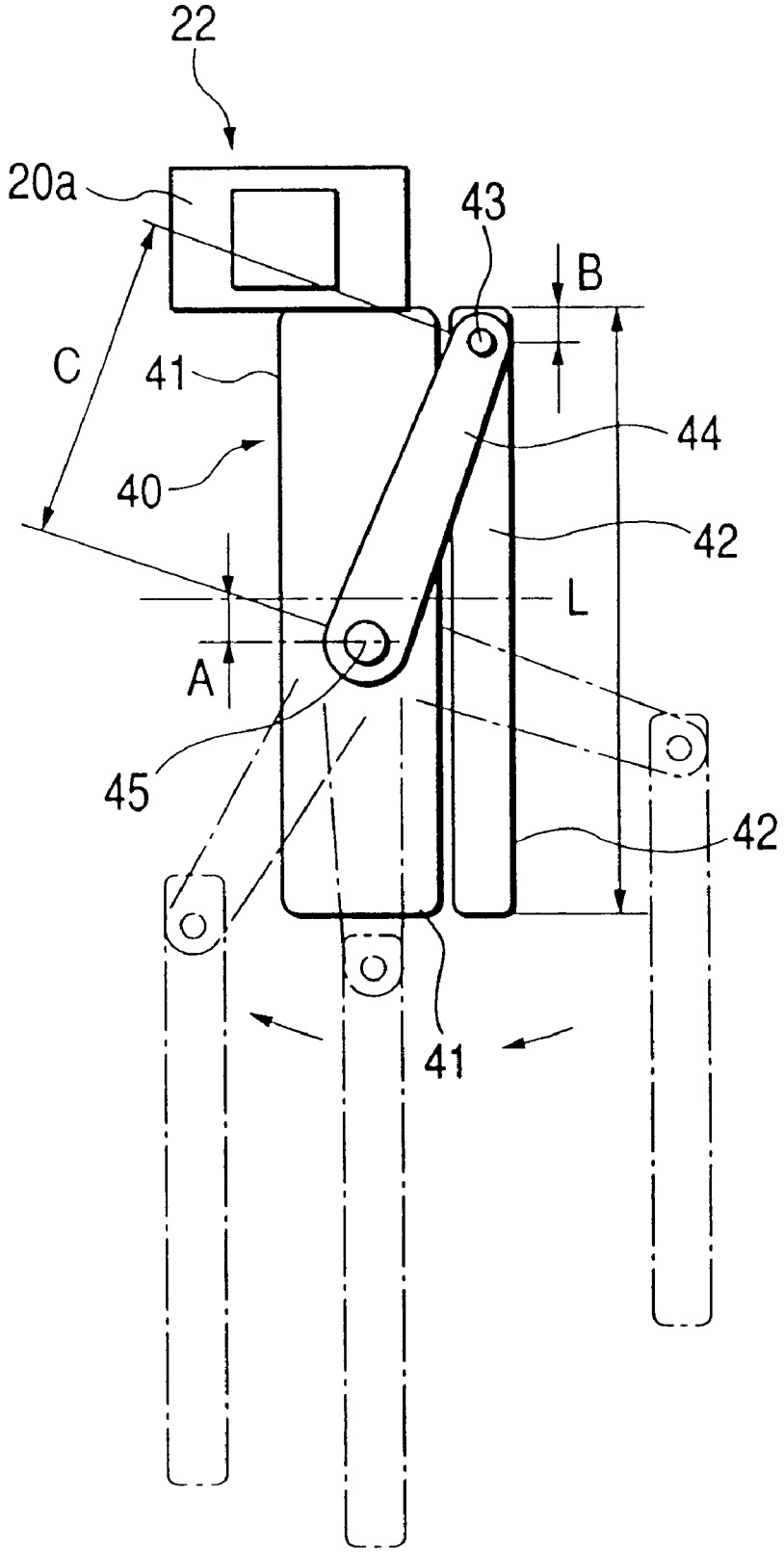
FIG. 7 is a plan view of the essential portions of a third embodiment of the present invention.
Figure 8:
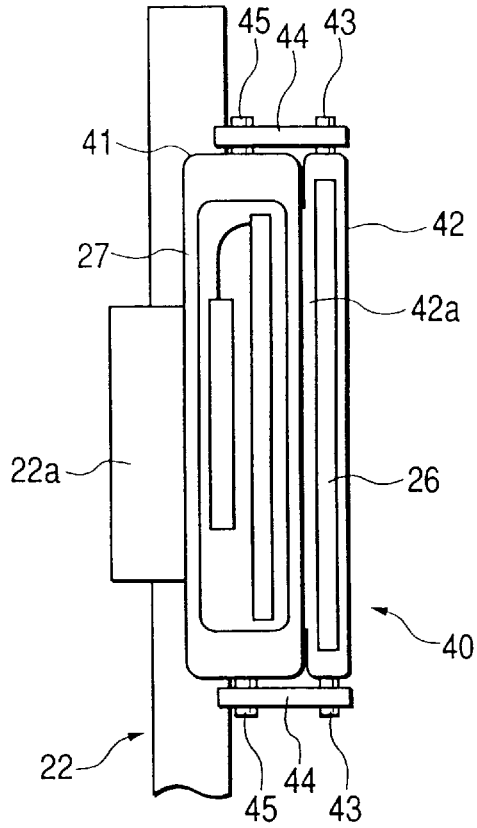
FIG. 8 is a side view of the third embodiment.

FIG. 7 is a plan view of the essential portions of a third embodiment, FIG. 8 is a side view (a cross-sectional view) thereof, and the grid 26 is connected to the main body housing 41 of the main body 40 of an apparatus through the connecting member of connecting means. An X-ray image receiving portion 27 is disposed in the interior of the main body housing 41, and a side of the main body housing 41 is supported in a cantilever fashion by the movable portion 22*a* of a stand 22. A grid housing 42 containing the grid 26 therein is connected to the front surface of the main body housing 41, and an opening 42*a* is formed in the rear surface of this grid housing 42. The grid housing 42 is retractable to the rear portion of the main body housing 41 through another side of the main body housing 41.

For this purpose, a shaft 43 is provided upright in the upper and lower surfaces of the grid housing 42, and a fitting hole in one end portion of a plate-like connecting member 44 is fitted on the shaft 43, and a fitting hole in the other end portion of the connecting member 44 is fitted on a shaft 45 provided upright in the upper and lower surfaces of the main body housing 41. Thereby, the connecting member 44 is rotatable relative to the shaft 43 and the shaft 45.

The shaft 45 is disposed at a distance A from the center of the main body housing 41, and the shaft 43 is disposed at a distance B from the end portion of the grid housing 42. Among these distances A and B, the distance C between the centers of the fitting holes in the connecting member 44 and the width L of the main body housing 41, there is established the relation that $A+C-B \geqq L/2$.

Figure 9:
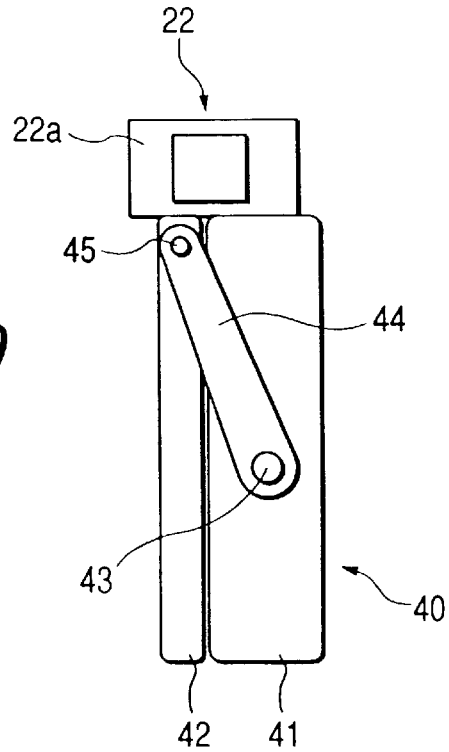
FIG. 9 is an illustration of action.
Figure 10:
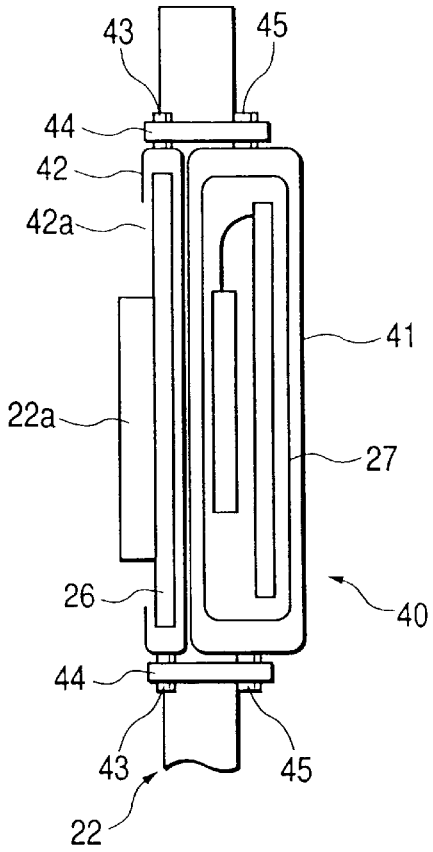
FIG. 10 is an illustration of action.

In the photographing not using the grid 26, the grid housing 42 is moved as indicated by dot-and-dash line. At this time, the connecting member 44 rotates clockwisely about the shaft 45 and rotates counter-clockwisely about the shaft 43 while holding the grid housing 42 at a position in which it does not interfere with the main body housing 41. Accordingly, the grid housing 42 is moved to a position in which it forms a substantially straight line with the main body housing 41, whereafter it goes round to behind the main body housing 41, and is moved to the back side of the main body housing 41 with the opening 42*a* exposed rearwardly as shown in FIGS. 9 and 10. Thus, the connecting member 44, as an arm mechanism, guides the grid housing 42 to behind the main body housing 41. Thereby, with the direction of the X-ray generating portion 21 as forward, the grid housing 42 is retracted more rearwardly than during the use thereof.

In this third embodiment, an effect similar to that of the first and second embodiment can be achieved and moreover, the grid housing 42 does not separate from the main body housing 41 and therefore, the weight of the grid housing 42 does not bother a photographer. Accordingly, the grid housing 42 can be operated by a light force. In addition, an erroneous installation of the grid with respect to the front and rear face thereof can be prevented when the grid is to be set in front of the X-ray image receiving portion 27.

Figure 11:
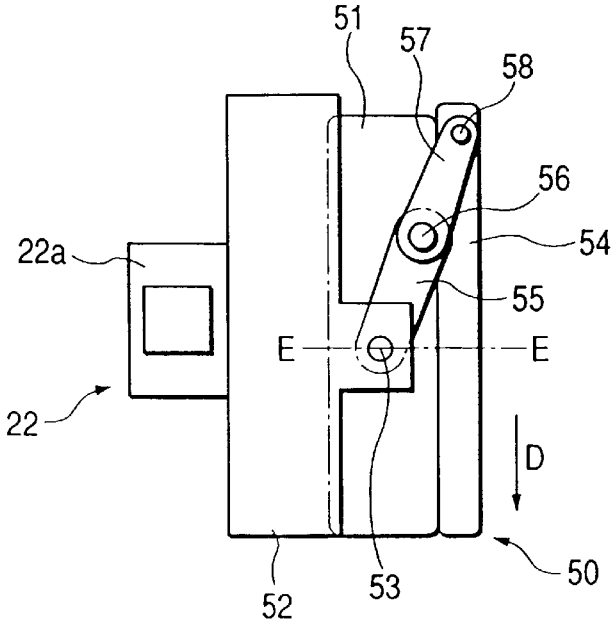
FIG. 11 is a plan view of the essential portions of a fourth embodiment of the present invention.
Figure 12:
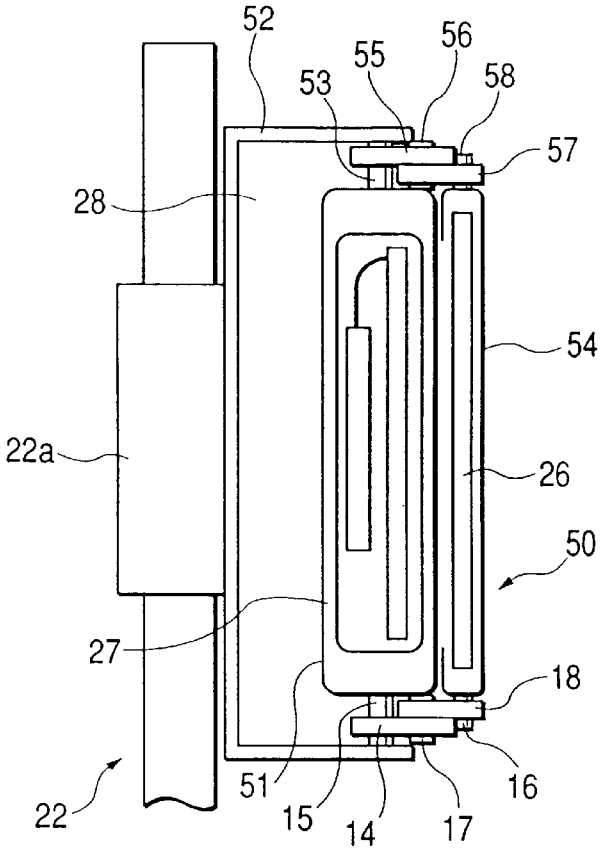
FIG. 12 is a side view of the fourth embodiment.

FIG. 11 is a plan view of the essential portions of a fourth embodiment, FIG. 12 is a side view (a cross-sectional view) thereof, and the grid 26 is connected to the main body housing 51 of the main body 50 of an apparatus through the two connecting members of connecting means. An X-ray image receiving portion 27 is provided in the interior of the main body housing 51, and the upper and lower surfaces of the main body housing 51 ate supported on a U-shaped frame member 52 fixed to the movable portion 22*a* of a stand 22, through a shaft 53. A grid housing 54 containing the grid 26 therein is retractable to a grid retracting space 28 inside the frame member 52 through a side of the main body housing 51.

A fitting hole in one end portion of one plate-like connecting member 55 is fitted on the shaft 53, and a shaft 56 is fitted in a fitting hole in the other end portion of the connecting member 55. A fitting hole in one end portion of the other plate-like connecting member 57 is fitted on this shaft 56, and a fitting hole in the other end portion of the connecting member 57 is fitted on a shaft 58 provided upright on the upper and lower surfaces of the grid housing 54. Thereby, the connecting members 55 and 57 are rotatable by the shafts 53, 56 and 58.

Figure 13:
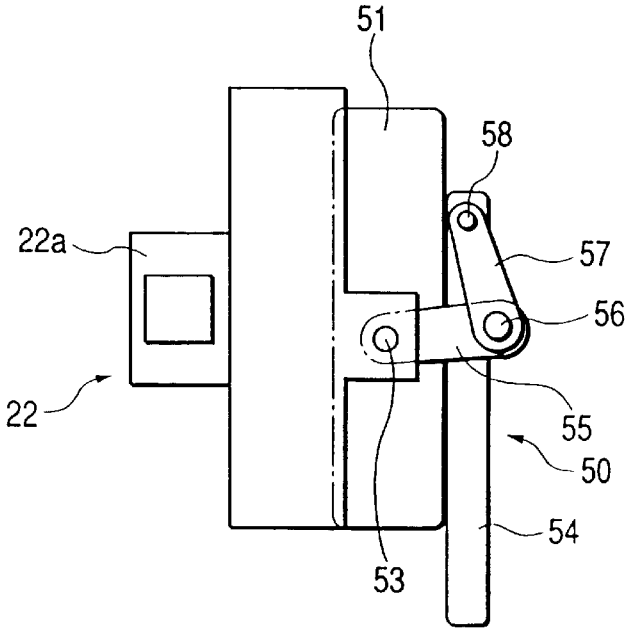
FIG. 13 is an illustration of action.
Figure 14:
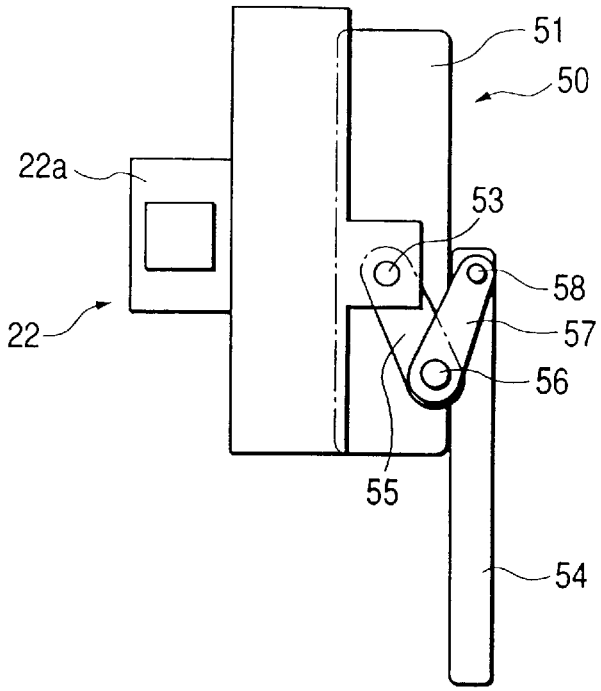
FIG. 14 is an illustration of action.
Figure 15:
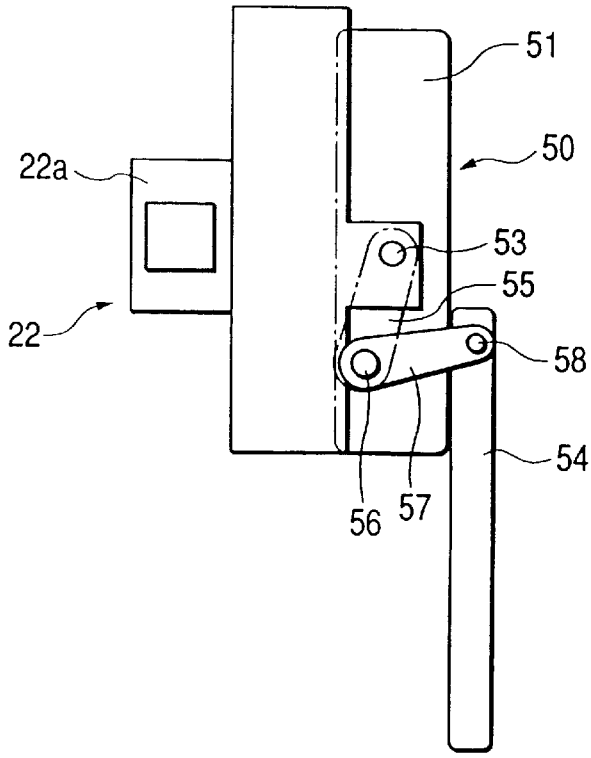
FIG. 15 is an illustration of action.

In the photographing not using the grid 26, when the grid housing 54 is moved in the direction of arrow D, one connecting member 55 rotates clockwisely about the shaft 53 as shown in FIG. 13 and the other connecting member 57 rotates counter-clockwisely about the shaft 56, and the angle formed between the connecting member 55 and the connecting member 57 gradually becomes smaller as shown in FIG. 14. Subsequently, as shown in FIG. 15, the connecting member 57 continues to rotate clockwisely, but the connecting member 55 begins to rotate counter-clockwisely.

Figure 16:
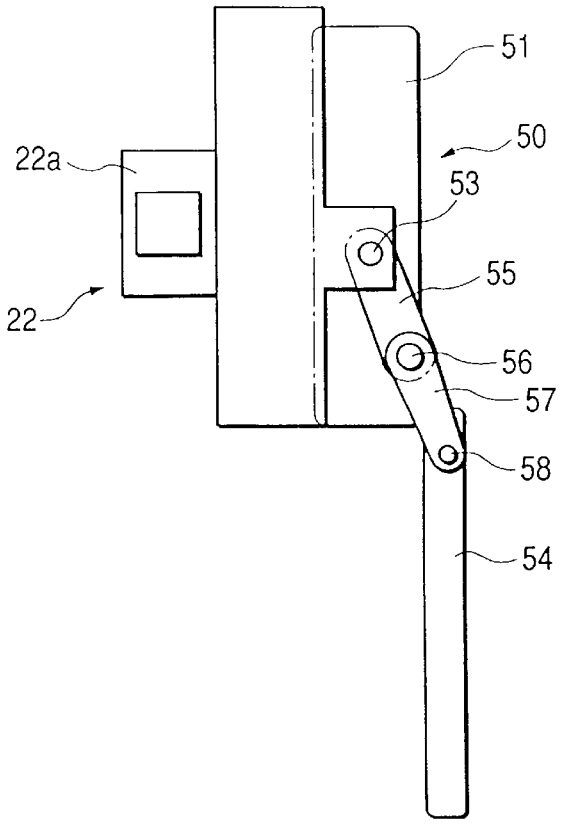
FIG. 16 is an illustration of action.

Further, as shown in FIG. 16, the connecting member 57 also begins to rotate counter-clockwisely, and the angle formed between the connecting member 55 and the connecting member 57 gradually becomes greater, and the parallel movement of the grid housing 54 in the direction of arrow D is terminated. At this time, the connecting members 55 and 57 are moved to positions substantially symmetrical with the positions before the movement is started, with respect to a segment E—E passing through the center of the shaft 53.

Figure 17:
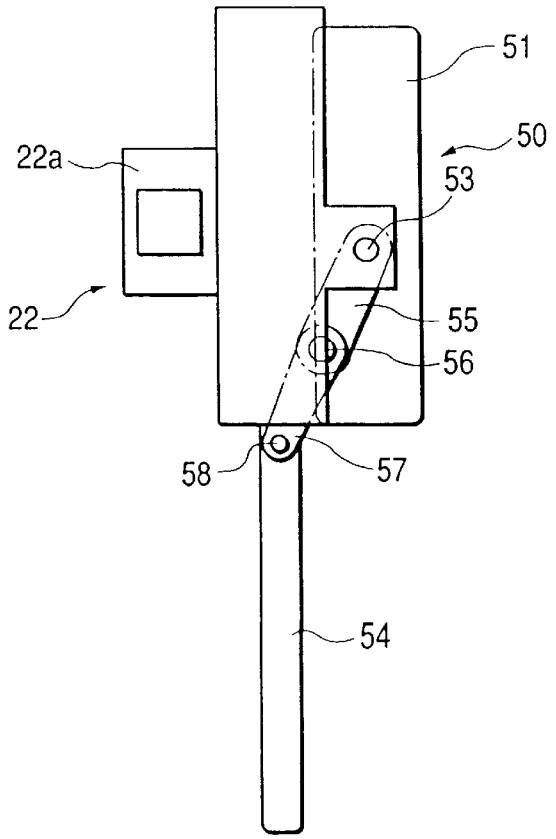
FIG. 17 is an illustration of action.
Figure 18:
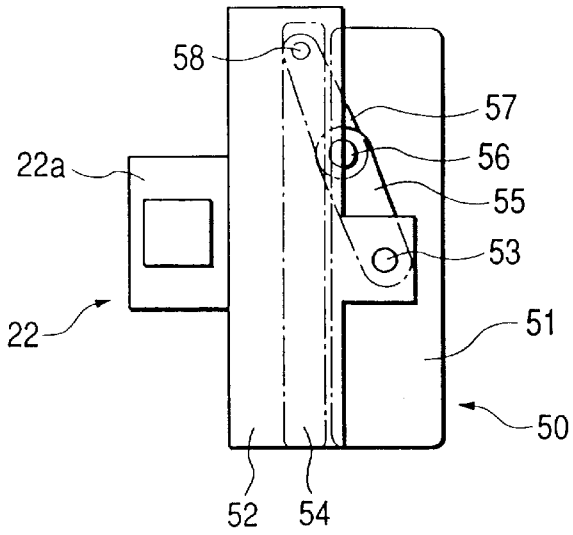
FIG. 18 is an illustration of action.
Figure 19:
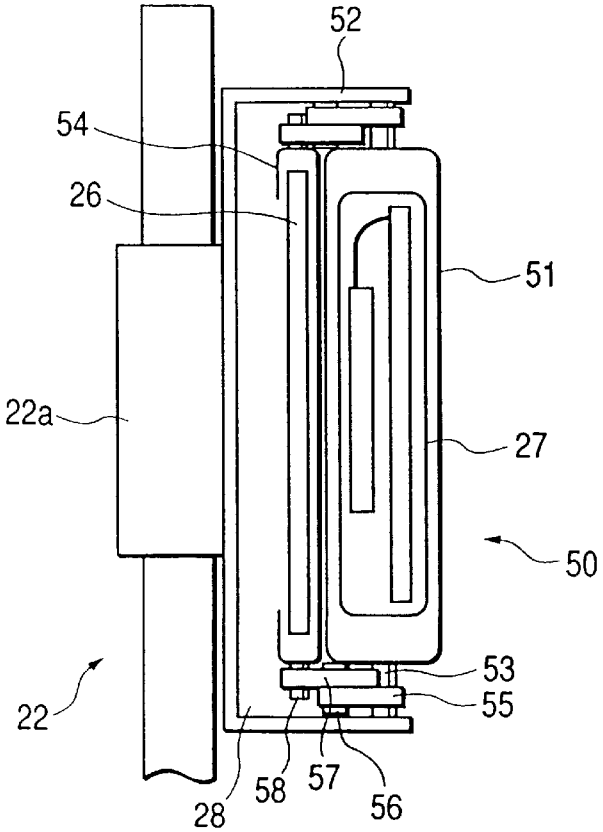
FIG. 19 is an illustration of action.

When the grid housing 54 is moved rearwardly as shown in FIG. 17, the connecting members 55 and 57 integrally rotate clockwisely about the shaft 53 and the grid housing 54 is moved to sideways of the grid retracting space 28. When finally the grid housing 54 is moved in a direction opposite to the direction of arrow D, the connecting members 55 and 57 operate quite conversely to the aforedescribed operation as shown in FIGS. 18 and 19, and the grid housing 54 is moved into the grid retracting space 28. Thus, the connecting members 55 and 57, as an arm mechanism, guides the grid housing 54 into the grid retracting space 28.

In this fourth embodiment, an effect similar to that of the third embodiment can be achieved and moreover, the grid housing does not longitudinally separate from the main body housing 51 and therefore, it becomes possible to limit the direction of movement and movement space of the grid housing 54 more than in the third embodiment.

Figure 20:
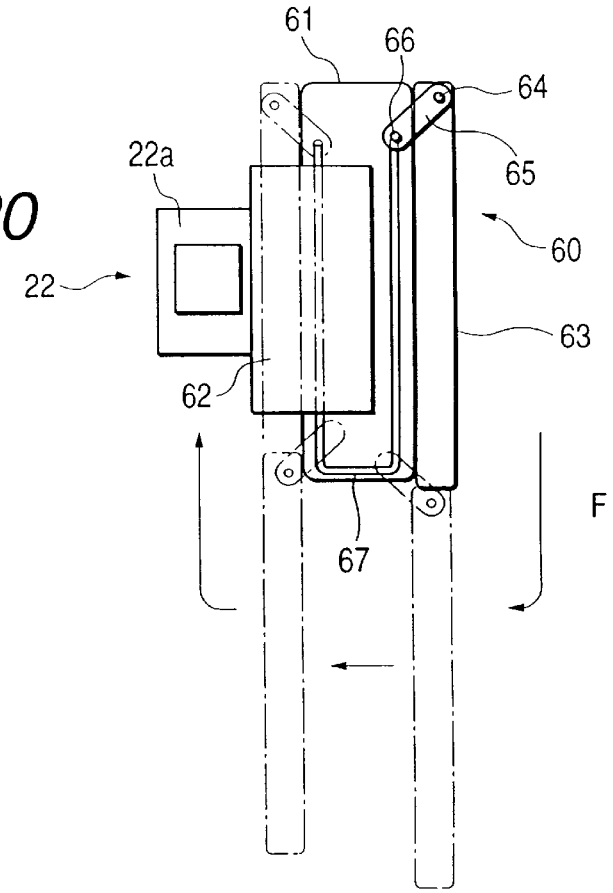
FIG. 20 is a plan view of the essential portions of a fifth embodiment of the present invention.
Figure 21:
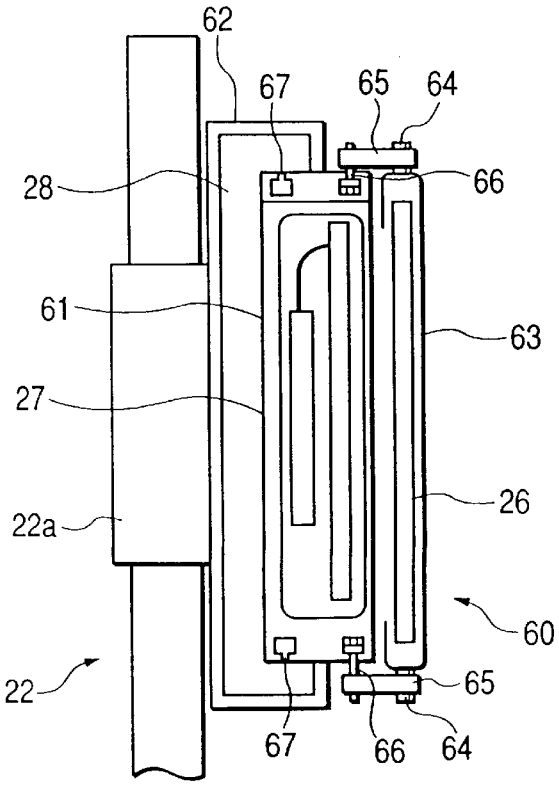
FIG. 21 is a side view of the fifth embodiment.

FIG. 20 is a plan view of the essential portions of a fifth embodiment, FIG. 21 is a side view (a cross-sectional view) thereof, and the grid 26 is connected to the main body housing 61 of the main body 60 of an apparatus through the connecting member of connecting means and guide means. An X-ray image receiving portion 27 is contained in the main body housing 61, which is supported on the movable portion 22*a* of a stand 22 through a U-shaped frame member 62. In this case, the substantially longitudinally intermediate portion of the upper and lower surfaces of the main body housing 61 is connected to the frame member 62. A grid housing 63 holding the grid 26 is supported on the front surface of the main body housing 61, and this grid housing 63 is retractable into a grid retracting space 28 in the frame member 62.

A shaft 64 is provided upright in the upper and lower surfaces of the grid housing 63, and a fitting hole in one end portion of a connecting member 65 is fitted on this shaft 64. On the other end portion of the connecting member 65, a projection 66 having a T-shaped cross-section is provided toward the main body housing 61, and the projection 66 is engaged with guide grooves 67 formed in the upper and lower surfaces of the main body housing 61. Each guide groove 67 is formed into such U-shape that surrounds the connected portion of the main body housing 61 and the frame member 62, and the cross-sectional shape thereof is a T-shape with which the projection 66 of the connecting member 65 is engaged.

In the photographing not using the grid 26, when the grid housing 63 is moved in the direction of arrow F, the connecting member 65 rotates clockwisely and also the projection 66 moves along the guide grooves 67, and the grid housing 63 moves as indicated by dots-and-dash line and is retracted into the grid retracting space 28 inside the frame member 62. This fifth embodiment can also achieve an effect similar to that of the fourth embodiment.

The projection 66 is provided on the connecting member 65, but a roller may be rotatably provided instead of the projection 66. The guide grooves 67 need not be U-shaped, but may be of a sidelong U-shape. The curve portion of the U-shape may be triangular.

Figure 22:
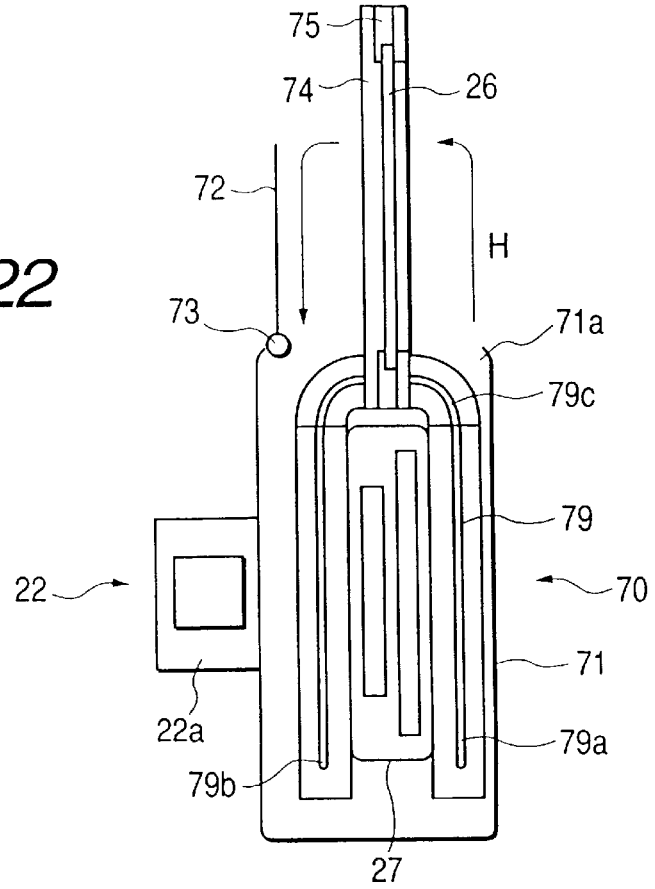
FIG. 22 is a plan view of the essential portions of a sixth embodiment of the present invention.
Figure 23:
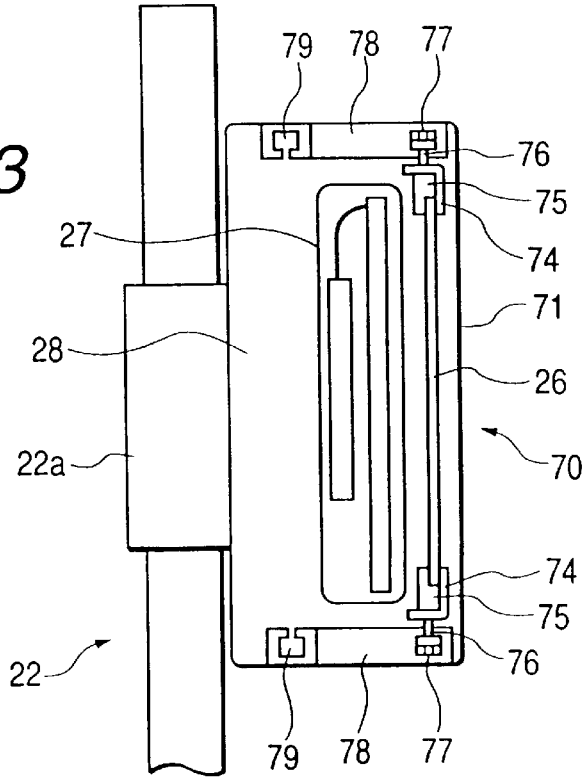
FIG. 23 is a side view of the sixth embodiment.
Figure 25:
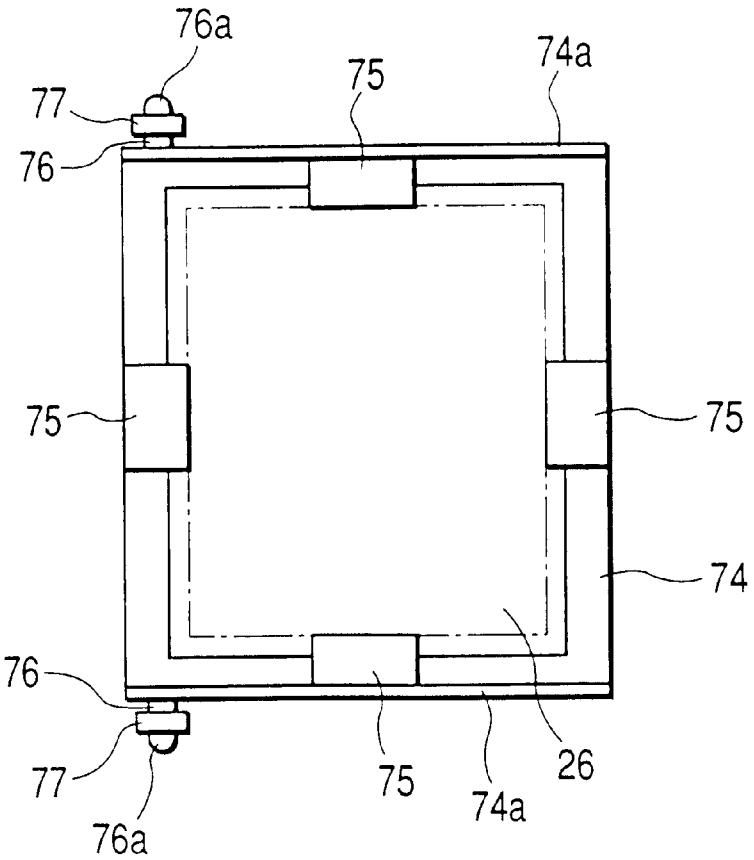
FIG. 25 is a view taken along the arrow G of FIG. 24.
Figure 24:
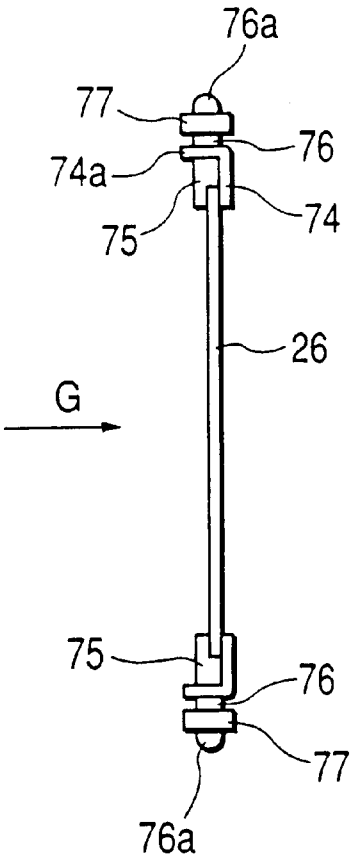
FIG. 24 is an enlarged view of a portion.

FIG. 22 is a plan view (a cross-sectional view) of the essential portions of a sixth embodiment, FIG. 23 is a side view (a cross-sectional view) thereof, FIG. 24 is an enlarged view of a portion, FIG. 25 is a view taken along the arrow G of FIG. 24, and the grid 26 is connected to the main body housing 71 of the main body 70 of an apparatus through connecting means and guide means. The rear surface of the main body housing 71 is supported on the movable portion 22*a* of a stand 22, and an opening 71*a* is formed in a side of the main body housing 71, and a cover 72 for opening and closing this opening 71*a* is supported on the main body housing 71 through a hinge 73. Both of the grid 26 and the X-ray image receiving portion 27 are contained in the main body housing 71, and the rear portion of the X-ray image receiving portion 27 in the main body housing 71 is made into a grid retracting space 28 into which the grid 26 is retracted.

The grid 26 is held on a frame member 74 through four upper, lower, left and right fixing members 75. The frame member 74 is formed with ribs 74*a*, whereby the strength of the frame member 74 is heightened. A shaft 76 having a spherical portion 76*a* at the tip end thereof is provided upright in one end portion of the upper and lower ribs 74*a*, and rollers 77 are rotatably provided on the shaft 76.

On the other hand, guide members 78 formed of a material having a good slipping characteristic such as polyacetal are provided on the upper and lower inner surfaces of the main body housing 71, and these guide members 78 are formed with guide grooves 79 engaged with the rollers 77. The guide grooves 79 are formed into such a U-shape that surrounds the X-ray image receiving portion 27, and have parallel straight portions 79*a* and 79*b*, and a curved portion 79*c* connecting these straight portions 79*a* and 79*b* together, and the cross-sectional shape thereof is a T-shape with which the roller 77 is engaged.

In the photographing not using the grid 26, the cover 72 is opened and the frame member 74 is moved in the direction of arrow H. At this time, the rollers 77 slide from the straight portion 79*a* of the guide groove 79 through the curved portion 79*c* to the straight portion 79*b*, and the frame member 74 is retracted into the grid retracting space 28. After the frame member 74 is retracted into the grid retracting space 28, the cover 72 is closed. This sixth embodiment can also achieve an effect similar to that of the fourth embodiment.

While the first to sixth embodiments have been described with respect to a radiation photographing apparatus using the grid 26, the construction in which the grid 26 is retracted from the front of the X-ray image receiving portion 27 can be applied to retract an X-ray detector from the front of the X-ray image receiving portion 27 in a radiation photographing apparatus using both of the grid 26 and the X-ray detector. Further, it is possible to provide such construction that the grid and the X-ray detector may be integrally retracted from the front of the X-ray image receiving portion 27.

Also, while the present invention has been described with respect to a radiation photographing apparatus for effecting upright photographing, the present invention is also applicable, for example, to a table type radiation photographing apparatus, and particularly the fourth to sixth embodiments are suitable for a table type radiation photographing apparatus in which the X-ray image receiving portion 27 is installed in a narrow space between a top plate for carrying an object thereon and the frame of a table.

While in the first to sixth embodiments, the radiation image digital detector 27*a* is used as the X-ray image receiving portion 27, for example, a cassette containing X-ray photographic film or an accumulative fluorescent material sheet therein can be used instead of the radiation image digital detector 27*a* to achieve a similar effect.

Also, in the foregoing description of the embodiments, the number of the retractable or mountable grid is one, but a plurality of grids may be used.

As a modification of the first embodiment, an example of a photographing apparatus which can also use, for example, two kinds of grids differing in characteristic will hereinafter be described with reference to FIG. 26.

The retracting space 28 in the present embodiment is wide as compared with that in the first embodiment and can contain three grids (26, 80, 81) therein. At the same time, three guide members for guiding the grids are prepared correspondingly to the three grids.

In such a form, a plurality of grids can be selectively disposed in front of the X-ray image receiving portion 27 and are retractable rearwardly and therefore, photographing using an optimum grid for a region to be photographed becomes possible. For example, in the photographing of the breast, a grid having the characteristics of grid density of 40 lines/cm, a grid ratio of 12:1 and a focal length of 180 cm is used, and in the photographing of the abdomen, a grid having the characteristics of grid density of 34 lines/cm, a grid ratio of 8:1 and a focal length of 100 cm is used, and it also becomes possible to retract the grid which is not used in photographing.

Figure 27:
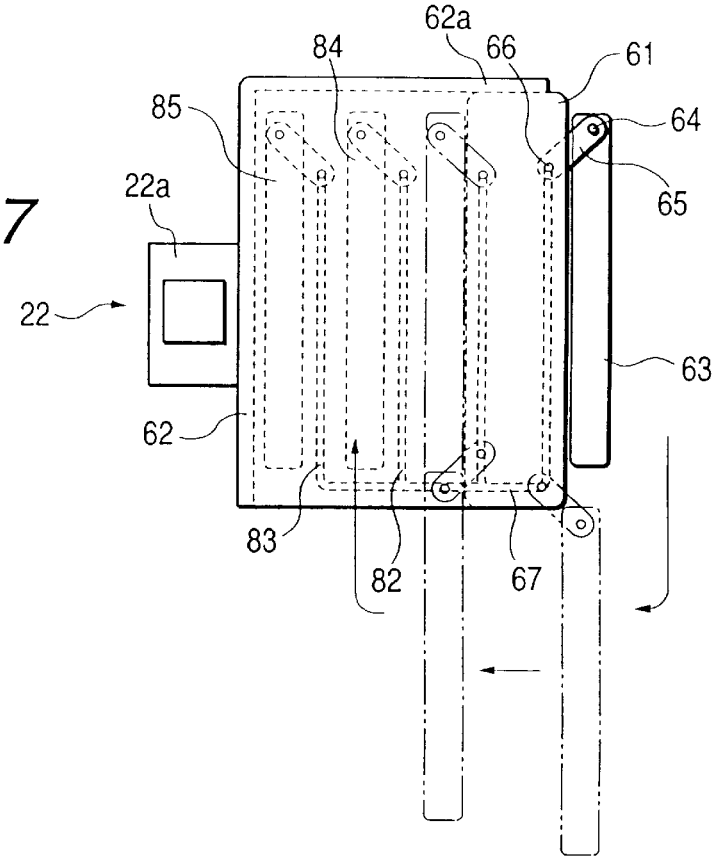
FIG. 27 is a plan view of the essential portions of an eighth embodiment of the present invention.

FIG. 27 shows a plan view of a modification of the fifth embodiment. Again in this modification, a plurality of grids differing in characteristic are usable.

In the present modification, a frame member 62 connected to a main body housing 61 has such a shape that covers the main body housing 61 and the grid retracting space 28, and a guide groove 67 is formed in this frame member 62, and one U-shaped corner of the guide groove 67 and the end portion of an L-shaped guide groove 82 are connected together. Further, the end portion of another L-shaped guide groove 83 is connected to the corner of the L-shaped guide groove 82.

The grid retracting space 28 has an area which can contain further two grid housings 84 and 85 besides a grid housing 63.

The frame member 62, like that in the fifth embodiment, is fixed to the movable portion 22*a* of the stand 22. However, the main body housing 61 and the frame member 62 are connected together by only the L-shaped bent portion 62*a* of the frame member 62, and the main body housing 61 is in a cantilever fashion.

Figure 28:
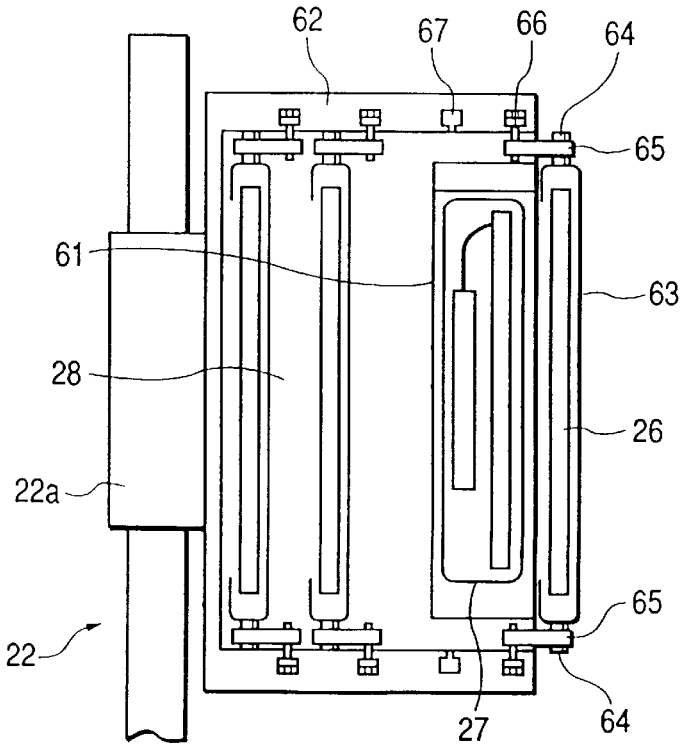
FIG. 28 is a side view of the eighth embodiment.

On the other hand, as shown in FIG. 28 which is a side view (a cross-sectional view) of the modification of FIG. 27, a projection 66 of a T-shaped cross-section provided on a connecting member 65 is provided away from the main body housing 61, and is engaged with guide grooves 67 formed in the upper and lower surfaces of the frame member 62.

In such a form, as in the modification of the first embodiment, a plurality of grids can be selectively disposed in front of the X-ray image receiving portion 27 and are retractable rearwardly and therefore, photographing using an optimum grid for the region to be photographed becomes possible.

In the foregoing description, the movement and retraction of the grid have been described, but the presence of the optimum grid in conformity with the region to be photographed also means that the optimum grid can be selected if the information of the region to be photographed is given before photographing.

For example, there is a case where the information of the region to be photographed is inputted to a control portion through an input portion annexed to the display portion 14, or a hospital information system HIS or a radiological information system RIS.

In that case, it is also possible to utilize the construction of each aforedescribed embodiment to adopt a construction in which an optimum grid for the region to be photographed is selected from among a plurality of grids differing in characteristic and is automatically moved to the front of the X-ray image receiving portion. Also, in a region to be photographed not using a grid, when a grid is disposed in front of the X-ray image receiving portion, it is conceivable to automatically retract the grid.

The information of the region to be photographed given before photographing can be effectively used not only in a case where the movement and retraction of the grid are selectively automatically effected as described above, but also in a case where the movement and retraction of the grid are manually effected.

Figure 26:
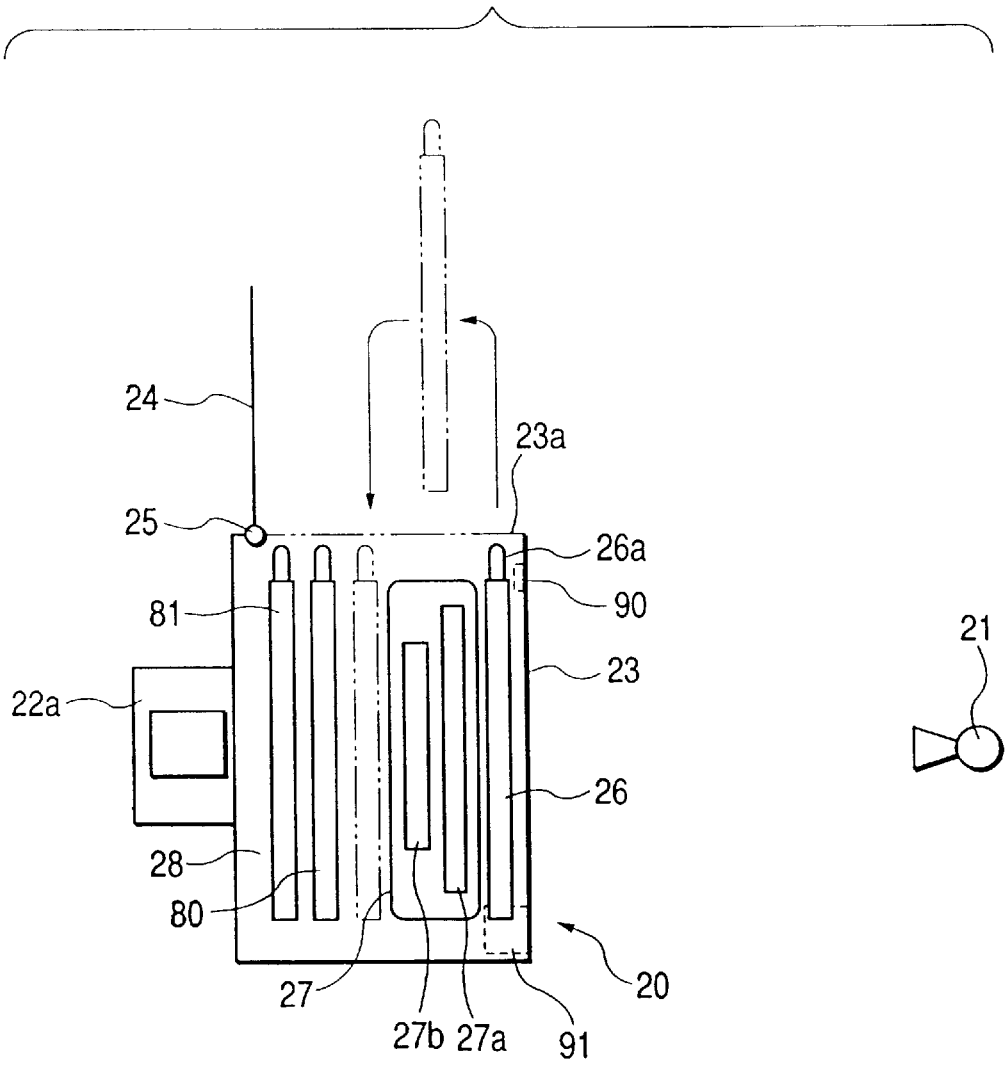
FIG. 26 is a plan view of the essential portions of a seventh embodiment of the present invention.

For example, in FIG. 26, when in the case of photographing in which the inputted region is to be photographed using the grid, it is detected by a sensor 90 indicated by dotted line that the grid has been disposed in front of the X-ray image receiving portion or that more preferably, a grid suited for the region to be photographed has been disposed in front of the X-ray image receiving portion, such a lock mechanism 91 indicated by dotted line that the grid cannot be retracted is operated into its locking state, whereby it can be prevented to change the grid for another grid by mistake or to photograph without using the grid.

Also, with the grid disposed in front of the X-ray image receiving portion, in the case of photographing in which the inputted region is to be photographed not using the grid or when the disposed grid is not preferable to the inputted region to be photographed, the kind of the grid is judged by the output from the sensor 90 by the use, for example, of a control device, not shown, and the lock mechanism is operated into its unlocking state so that the grid can be retracted, and such display that suggests the retraction or change of the grid is effected by a display device, not shown to thereby call the user's attention, or when the grid is not properly selected, photographing is made impossible, whereby wrong photographing can be prevented.

In the radiation photographing apparatus according to each embodiment described above, at least one of the scattered ray removing means and the radiation detecting means is made movable to the back opposite to the object side of the radiation image receiving portion and therefore, at least one of the scattered ray removing means and the radiation detecting means can be easily retracted. Accordingly, broad forms of photographing such as photographing using the scattered ray removing means, photographing not using the scattered ray removing means, photographing using the radiation detecting means, photographing not using the radiation detecting means and photographing with the object brought into close contact can be effected easily and inexpensively by the same apparatus. Also, it is unnecessary to carry or keep the radiation image receiving portion, the scattered ray removing means and the radiation detecting means to or in a remote depository and therefore, they do not bother the photographer.

Further, if at least one of the scattered ray removing means and the radiation detecting means is connected to the radiation image receiving portion through connecting means, the weight thereof will not bother the photographer. If the scattered ray removing means or the radiation detecting means is guided by guide means, it will become possible to limit the direction of movement and movement space thereof, and this can contribute to an improvement in operability and a reduction in the installation space.

Also, at least one of the scattered ray removing means and the radiation detector can be guided by guide means or an arm mechanism so as to be retracted more rearwardly than during the use and can therefore be simply retracted rearwardly so as not to hinder the photographing during the non-use.

Further, if design is made such that the operation of lock means for imparting a limitation to the movement and retraction of the scattered ray removing means is controlled on the basis of the information of the region to be photographed inputted by input means for inputting the region to be photographed of the object, it will become possible to prevent wrong photographing with respect to the presence or absence and characteristic of the scattered ray removing means related to the region to be photograped.

What is claimed is:

1. A radiation photographing apparatus comprising:

a radiation image receiving portion receiving radiation emitted from a radiation generating portion and transmitted through an object and obtaining a radiation image;

a first portion including a scattered ray removing member for removing radiation scattered by the object or a radiation detector for use in controlling an exposure to the radiation of said radiation image receiving portion;

a supporting portion for supporting said first portion so that said first portion is movable between a position on a radiation generating portion side of said radiation image receiving portion and a position on a side opposite to the radiation generating portion side of said radiation image receiving portion substantially without being separated from said radiation image receiving portion.

2. The apparatus of claim 1, further comprising a housing or a frame member covering said radiation image receiving portion and wherein said first portion is held on said housing or said frame member by said supporting portion.

3. The apparatus of claim 1, wherein said supporting portion comprises a connecting mechanism and said first portion is connected to said radiation image receiving portion through said connecting mechanism.

4. The apparatus of claim 3, wherein said first portion comprises a guide portion having a predetermined route, and said connecting mechanism comprises an engagement member engaged with said guide portion and movable on said guide portion.

5. The apparatus of claim 4, wherein said guide portion has a U-shaped route as the predetermined route.

6. The apparatus of claim 3, wherein said connecting mechanism comprises at least two members rotatably coupled together.

7. The apparatus of claim 1, wherein said radiation image receiving portion comprises a radiation image detector in which a plurality of detecting elements for converting the radiation into charges are two-dimensionally arranged, and a signal reading circuit for reading an output signal from said radiation image detector.

8. The apparatus of claim 1, comprising a plurality of said first portions, each of which includes a scattered ray removing member, and each said scattered ray removing member differing in kind from others, and one of said first portions can be selectively disposed at the position on the radiation generating portion side.

9. The apparatus of claim 8, wherein said supporting portion comprises a guide portion for selectively disposing one of said first portions at the position on the radiation generating portion side, and wherein each of said first portions comprises an engagement portion engaged with said guide portion.

10. The apparatus of claim 8, further comprising detecting means for detecting a scattered ray removing member included in said first portion, and lock means for fixing said first portion at the position on the radiation generating portion side on the basis of a result of the detection by said detecting means.

11. The apparatus of claim 1, further comprising lock means for imparting a limitation to movement of said first portion from the position on the radiation generating portion side.

12. The apparatus of claim 11, wherein said lock means is operated by detecting disposition of said first portion at a position on the radiation generating portion side.

13. The apparatus of claim 11, wherein said lock means is operated on the basis of information regarding a region to be photographed and information regarding a scattered ray removing member included in said first portion.

14. The apparatus of claim 1, wherein said supporting portion guides said first portion to move between the position on the radiation generating portion side during the use of said first portion and the position on the side opposite to said radiation generating portion side during the non-use of said first portion.

15. The apparatus of claim 14, wherein said supporting portion comprises a guide groove, and an engagement portion for engagement with said guide groove.

16. The apparatus of claim 1, wherein said supporting portion comprises an arm mechanism holding said first portion and capable of displacing said first portion between the position on the radiation generating portion side during the use of said first portion and the position on the side opposite to the radiation generating portion side during the non-use of said first portion.

17. The apparatus of claim 16, wherein said arm mechanism comprises a plurality of connecting members rotatable relative to one another.

18. A radiation photographing apparatus having:

a radiation image receiving portion for receiving radiation emitted from a radiation generating portion and transmitted through an object and obtaining a radiation image;

a first portion including a scattered ray removing member or a radiation detector for use in controlling an exposure to the radiation of said radiation image receiving portion; and guide means designed to guide said first portion to move between a position on a radiation generating portion side of said radiation image receiving portion during the use of said first portion and a position on a side opposite to said radiation generating portion side of the radiation image receiving portion during the non-use of said first portion.

19. The apparatus of claim 18, wherein said guide means comprises a guide groove and an engagement portion for engagement with said guide groove provided on said first portion.

20. A radiation photographing apparatus having:

a radiation image receiving portion for receiving radiation emitted from a radiation generating portion and transmitted through an object and obtaining a radiation image;

a first portion including a scattered ray removing member or a radiation detector for use in controlling an exposure to the radiation of said radiation image receiving portion; and an arm mechanism holding said first portion and capable of displacing said first portion between a position on a radiation generating portion side of said radiation image receiving portion during the use of said first portion and a position on a side opposite to the radiation generating portion side of said radiation image receiving portion during the non-use of said first portion.

21. The apparatus of claim 20, wherein said arm mechanism comprises a plurality of connecting rotatable relative to one another.

* * * * *

UNITED STATES PATENT AND TRADEMARK OFFICE

CERTIFICATE OF CORRECTION

PATENT NO. : 6,434,218 B1
DATED : August 13, 2002
INVENTOR(S) : Kazuhiro Matsumoto It is certified that error appears in the above-identified patent and that said Letters Patent is hereby corrected as shown below:

Column 1,
Line 52, "electrically conductive film and" (second occurrence) should be deleted.

Column 14,
Line 26, "connecting" should read -- connecting members --.

Signed and Sealed this

Thirteenth Day of May, 2003

JAMES E. ROGAN
*Director of the United States Patent and Trademark Office*